US012276489B2

(12) United States Patent
Jang

(10) Patent No.: US 12,276,489 B2
(45) Date of Patent: Apr. 15, 2025

(54) DETONATOR CONNECTOR HAVING LEG WIRE LOCKING STRUCTURE

(71) Applicant: HANWHA CORPORATION, Seoul (KR)

(72) Inventor: Woo Young Jang, Suwon-si (KR)

(73) Assignee: HANWHA CORPORATION, Seoul (KR)

( * ) Notice: Subject to any disclaimer, the term of this patent is extended or adjusted under 35 U.S.C. 154(b) by 0 days.

(21) Appl. No.: 18/279,246

(22) PCT Filed: Jul. 7, 2023

(86) PCT No.: PCT/KR2023/009643
§ 371 (c)(1),
(2) Date: Aug. 29, 2023

(87) PCT Pub. No.: WO2024/128444
PCT Pub. Date: Jun. 20, 2024

(65) Prior Publication Data

US 2025/0076017 A1 Mar. 6, 2025

(30) Foreign Application Priority Data

Dec. 14, 2022 (KR) ..... 10-2022-0174431

(51) Int. Cl.
*F42D 1/045* (2006.01)

(52) U.S. Cl.
CPC ..... *F42D 1/045* (2013.01)

(58) Field of Classification Search
CPC ..... F42C 19/12; F42D 1/045; F42D 3/04
USPC ..... 102/202.5–202.14; 361/251
See application file for complete search history.

(56) References Cited

U.S. PATENT DOCUMENTS 3,815,501 A * 6/1974 Anderson ..... F42D 3/06 102/315
5,305,957 A * 4/1994 Szocs ..... B01F 23/30 169/58
2021/0404784 A1 12/2021 Lee et al.

FOREIGN PATENT DOCUMENTS

CN 210718862 U 6/2020
KR 10-2020-0076362 A 6/2020

* cited by examiner

*Primary Examiner* — Michael D David
(74) *Attorney, Agent, or Firm* — WHDA, LLP

(57) ABSTRACT

A detonator connector having a leg wire locking structure is proposed. The detonator connector includes an upper casing member for opening and closing a lower casing member having a wiring bracket member positioned therein and into which a leg wire of a detonator or a bus wire is inserted, and between the wiring bracket member and an leg wire entrance of the lower casing member, a leg wire position locking part for fixing a position of the leg wire by elastically catching and pressurizing the leg wire inserted into the lower casing member is positioned, so as to enable resiliently locking and fixing the position of a double-coated wire or single-coated wire, which are used as the leg wire, at an entrance side and to stably maintain an internal connection state, thereby securing connection stability and connection reliability between the leg wire and the bus wire.

17 Claims, 6 Drawing Sheets

DETONATOR CONNECTOR HAVING LEG WIRE LOCKING STRUCTURE

TECHNICAL FIELD

The present disclosure relates to a detonator connector having a leg wire locking structure and, more particularly, to a detonator connector having a wire fitting structure that may stably maintain, at an entrance side of the detonator connector, an internal connection state by fitting and fixing a double-coated wire or a single-coated wire, which is used as a leg wire.

BACKGROUND ART

In general, explosives are used for construction work such as demolition of bedrock for tunnel construction and demolition of abandoned buildings. That is, by dividing a blasting target by section, a plurality of holes into which the explosives are inserted is drilled. The explosives are inserted into the respective drilled holes and connected to a blasting system. Detonation of the blasting target is conducted by detonating the explosives through the manipulation of the blasting system.

The blasting system is configured to include: a detonator as an initial explosive for detonating an explosive; and a blasting machine for transmitting power and a command, which are required for operation of the detonator, to the detonator. In this case, an electric detonator or an electronic detonator is mainly used as a detonator of the blasting system. The electric detonator or the electronic detonator is installed on an explosive side, and a plurality of detonators is connected to one blasting machine.

The electric detonator or the electronic detonator includes: a structure that allows a plurality of detonators connected to a corresponding blasting machine to operate simultaneously and detonate explosives at the same time when a command is transmitted from the blasting machine; and a structure that allows a plurality of electronic detonators to be set at different delay times so that the plurality of detonators is sequentially operated, thereby detonating the explosives in sequence.

For a blasting work, a leg wire connected to an electric detonator or electronic detonator, or a bus wire connected to a blasting machine is used by peeling off the coating of an end of the leg or bus wire, and is connected to a bus wire, a leg wire, and an auxiliary bus wire of another electric detonator or another electronic detonator. In this case, there is always a risk of safety accidents due to an explosion caused by a connection part of a leg wire and the like that are likely to be exposed to an earth current or a leakage current in places such as a tunnel where a lot of water or moisture is present.

Such a safety accident becomes a bigger problem when an operator installing an electric detonator or an electronic detonator in an explosive directly contacts a tube of the electric detonator or electronic detonator.

Accordingly, a detonator connector has been proposed to prevent an accident that may occur when a leg wire and a bus wire of an electric detonator or an electronic detonator are electrically connected to each other.

The detonator connector not only prevents safety accidents due to an earth current, a leakage current, or the like, but also solves the trouble of having to peel off the coatings of the wires and connect the wires to each other directly by an operator.

As a previous patent related to the present patent application, Korea Utility Model Registration No. 20-0410147, "WIRE CONNECTOR FOR ELECTRIC DETONATOR" (registered on Feb. 24, 2006) has been proposed.

The conventional "wire connector for electric detonator" is configured to include: an insulation housing having side surfaces thereof provided with openings to allow respective leg wires to pass therethrough and be laid thereon; a pressurizing member having one end thereof hinged to the insulation housing and rotating downward; and an equipotential connection member formed with a plurality of leg wire connection long holes corresponding to the openings so as to allow both ends of each leg wire to be inserted to and fixed to inner sides of the insulation housing while being pressurized by the pressurizing member when the pressurizing member rotates downward.

The conventional "wire connector for electric detonator" has a structure that realizes equal potential of a leg wire as a part of a core material of the leg wire is cut open and installed to enable conduction in a connection long hole while the leg wire is inserted into the connection long hole by the downward rotational force of the pressurizing member.

However, when the conventional "wire connector for electric detonator" is electrically connected to logger equipment and initially inserted into a detonator to perform a tagging work for checking whether an abnormality exists in a connection between the detonator and the leg wire, there occurs inconvenience that the wire connector should be connected to an external terminal of the logger equipment in a state where an upper cover is opened to expose a wiring bracket to the outside.

In addition, the conventional "wire connector for electric detonator" has a problem in that a connection between a leg wire and a bus wire is unstable due to a single contact method using a straight line equipotential connection member.

DISCLOSURE

Technical Problem

An objective of the present disclosure is to provide a detonator connector having a leg wire locking structure that may fix a position thereof by elastically pressurizing a double-coated wire or a single-coated wire, which is used as a leg wire at an entrance side, so as to maintain a stable internal connection state.

Technical Solution

According to the present disclosure to achieve the above objective, there is provided an exemplary embodiment of a detonator connector having a leg wire locking structure, the detonator connector including: a wiring bracket member made of a conductive material and formed with a plurality of wire fitting grooves into which a leg wire of a detonator or a bus wire is inserted; a lower casing member on which the wiring bracket member is positioned; and an upper casing member for covering an upper part of the lower casing member, wherein a leg wire position locking part for catching and fixing a position of the leg wire may be positioned in an inside of the lower casing member.

The leg wire position locking part may be positioned between a leg wire entrance of the lower casing member and the wiring bracket member, and may elastically catch and pressurize the leg wire inserted into the inside of the lower casing member.

In the present disclosure, the leg wire position locking part may include a pair of leg wire support members positioned standing upright and spaced apart from each other in the inside of the lower casing member to support both side surfaces of the leg wire wired in between, and provided with leg wire catch jaw parts protruding to catch an upper part of the leg wire.

In the present disclosure, the pair of leg wire support members may have a rod shape, be positioned standing upright, and be provided with the leg wire catch jaw parts protruding inward and positioned to face each other.

In the present disclosure, an upper surface of each leg wire catch jaw part may be formed of a circular arc surface having a curvature equal to or greater than a curvature of the leg wire comprising a coating thereof.

In the present disclosure, the leg wire support members may include respective leg wire support rib parts extending and protruding from upper parts of the leg wire catch jaw parts to support both sides of the leg wire in between.

In the present disclosure, the leg wire position locking part may further include a leg wire support part having an upper part thereof on which the leg wire is placed, and the leg wire support part may be a support rod member disposed in a straight line in a wiring direction of the leg wire and having elasticity.

In the present disclosure, a lower surface of the upper casing member may be provided with a leg wire support protrusion part protruding to support an upper surface of the leg wire fixed by catching with the leg wire position locking part.

In the present disclosure, partition walls each provided with a leg wire entrance, through which the leg wire passes, may be provided on a front side or a rear side of the leg wire position locking part, and on both respective sides of the leg wire entrance, a first guide inclined surface and a second guide inclined surface, which have upper sides thereof, may be positioned and guide the leg wire so as to be inserted between the leg wire support members by moving the leg wire inward when the leg wire is inserted into the upper sides.

In the present disclosure, the inside of the lower casing member may include: a wiring space part provided with the wiring bracket members positioned therein and in which the leg wire and the bus wire are wired and connected to each other by the wiring bracket members; and a leg wire locking space part divided by a first partition wall at a front side of the wiring space part and provided with the leg wire position locking part positioned therein.

In the present disclosure, a casing locking part for fixing a position of the closed upper casing member may be provided on front sides of the lower casing member and the upper casing member, and the inside of the lower casing member may further include a casing locking space part divided by a second partition wall at a front side of the leg wire locking space part and provided with the casing locking part therein.

In the present disclosure, the leg wire position locking part may further include a leg wire support part having an upper part thereof on which the leg wire is placed, the leg wire support part may be a support rod member disposed in a straight line in a wiring direction of the leg wire and having elasticity, and opposite end sides of the support rod member may be respectively fixed to the first partition wall and the second partition wall and positioned to be spaced apart from a lower surface of the lower casing member.

In the present disclosure, the casing locking part may include: an elastic locking panel part elastically bent in forward and backward directions, provided with first locking catch jaws protruding from lower end sides thereof, and positioned on a front side of the upper casing member so as to be inserted into the casing locking space part; and first locking catch parts by which the first locking catch jaws are caught and positioned within the casing locking space part.

In the present disclosure, the casing locking part may further include: second locking catch jaw parts positioned on both sides of the lower casing member; locking side parts positioned to cover the second locking catch jaw parts on the front side of the upper casing member; and second locking catch parts positioned on inner surfaces of the locking side parts and into which the second locking catch jaw parts are inserted and caught.

In the present disclosure, the elastic locking panel part may be provided with an unlocking handle part protruding from a front side thereof and enabling an operator to pull or push the elastic locking panel by hand manipulation.

In the present disclosure, a first leg wire entrance positioned on the front side of the lower casing member and through which the leg wire passes may be formed in a shape open to an upper side, and the unlocking handle part may be provided with a locking stopper protrusion part protruding to be inserted into the first leg wire entrance at a front and allowing both sides thereof to be supported on inner surfaces of the first leg wire entrance, so as to guide forward and backward movement of the elastic locking panel part and restrict leftward and rightward movement of the elastic locking panel part.

In the present disclosure, a lower side surface fitting part into which both side parts of the lower casing member are fitted and inserted may be provided between the elastic locking panel part and the locking side parts.

In the present disclosure, the wiring bracket member may include: a first bus wire connection bracket part positioned apart from a first side surface of the lower casing member and to which a first bus wire is fitted and connected; a first leg wire connection bracket part formed by being bent at a first end side of the first bus wire connection bracket part and to which a first leg wire is fitted and connected; a second bus wire connection bracket part positioned apart from a second side surface of the lower casing member and to which a second bus wire is fitted and connected; and a second leg wire connection bracket part formed by being bent at a second end side of the second bus wire connection bracket part and to which a second leg wire is fitted and connected.

In the present disclosure, a wiring pressurizing part for pressurizing the leg wire or the bus wire, inserting the leg wire or the bus wire into a wire fitting groove, and wiring the leg wire or bus wire to the wiring bracket members may be positioned on a lower surface of the upper casing member, and the wiring pressurizing part may include: a first wiring pressurizing member inserted between the first side surface of the lower casing member and the first bus wire connection bracket part; a second wiring pressurizing member inserted between the first bus wire connection bracket part and the second bus wire connection bracket part; a third wiring pressurizing member inserted between the second bus wire connection bracket part and the second side surface of the lower casing member; a fourth wiring pressurizing member positioned at the first end side of the second wiring pressurizing member and provided with a first bracket insertion part into which the first leg wire connection bracket part is inserted; and a fifth connection pressure member positioned at the second end side of the second wiring pressurizing member and provided with a second bracket insertion part into which the second leg wire connection bracket part is inserted.

Advantageous Effects

The present disclosure has an effect that a position of a double-coated wire or single-coated wire used as a leg wire may be elastically locked and fixed at an entrance side, so as to stably maintain an internal connection state, thereby securing connection stability and connection reliability between the leg wire and a bus wire.

DESCRIPTION OF THE REFERENCE NUMERALS IN THE DRAWINGS

Figure 1:
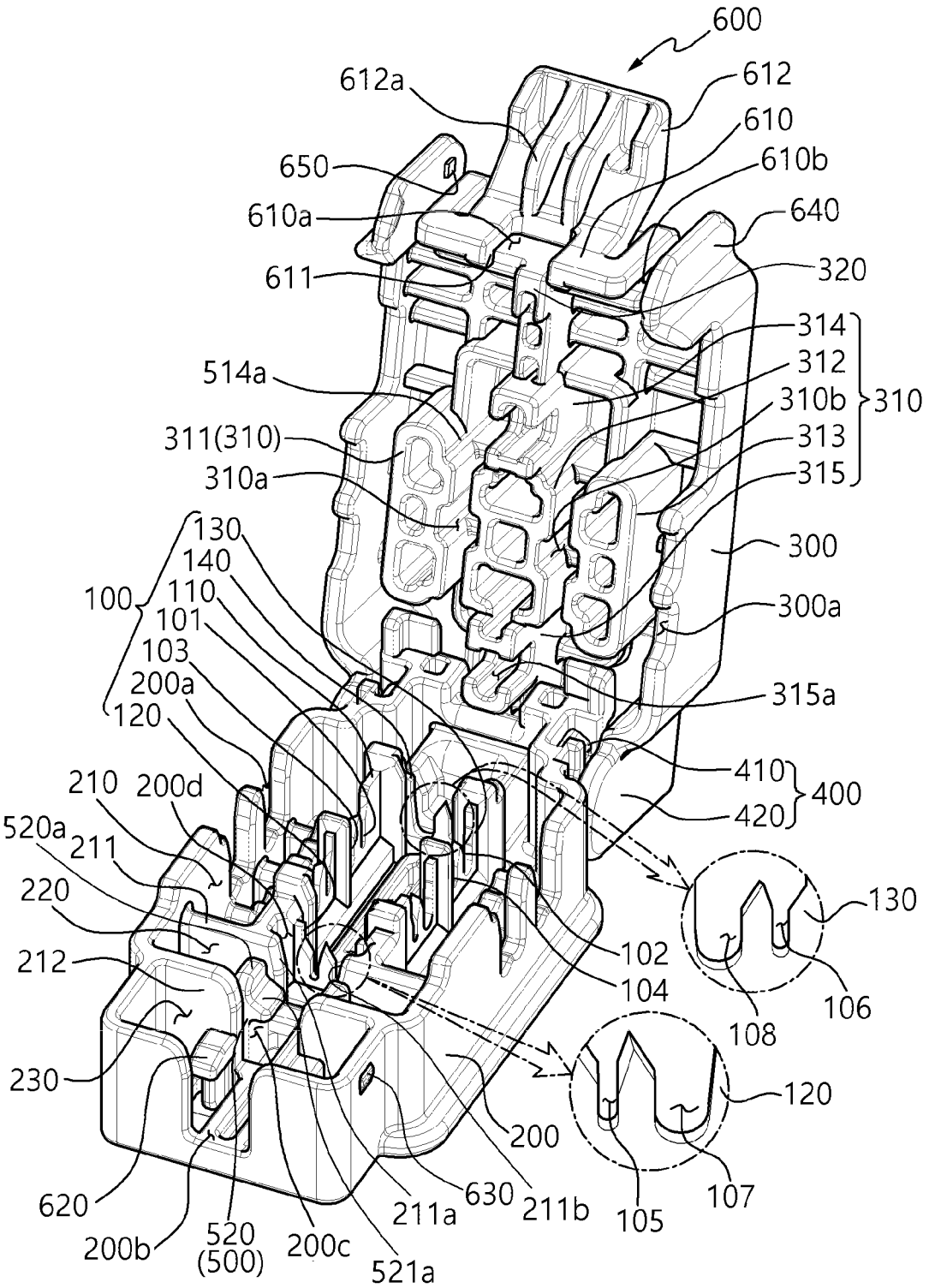
FIGS. 1 and 2 are views illustrating an exemplary embodiment of a detonator connector having a leg wire locking structure according to the present disclosure.

10: leg wire 11: first leg wire
12: second leg wire 20: bus wire
21: first bus wire 22: second bus wire
100: wiring bracket member 101: first bus wire fitting groove
102: second bus wire fitting groove 103: first bus wire through hole
104: second bus wire through hole 105: first leg wire fitting groove
106: second leg wire fitting groove 107: first leg wire through hole
108: second leg wire through hole
110: first bus wire connection bracket part
120: first leg wire connection bracket part
130: second bus wire connection bracket part
140: second leg wire connection bracket part
200: lower casing member 200*a*: side through hole
200*b*: first leg wire entrance 200*c*: second leg wire entrance
200*d*: third leg wire entrance 210: wiring space part
211: first partition wall 220: leg wire locking space part
221: second partition wall 230: casing locking space part
300: upper casing member 300*a*: bus wire pressurizing hole
310: wiring pressurizing part 310*a*: third bracket insertion part
310*b*: fourth bracket insertion part 311: first wiring pressurizing member
312: second wiring pressurizing member 313: third wiring pressurizing member
314: fourth wiring pressurizing member 314*a*: first bracket insertion part
315: fifth wiring pressurizing member 315*a*: second bracket insertion part
400: casing connection hinge part 410: hinge shaft
420: hinge cover part 500: leg wire position locking part
510: leg wire support part 511: support rod member
520: leg wire support member 521: leg wire catch jaw part
521*a*: circular arc surface 600: casing locking part
610: elastic locking panel part 610*a*: leg wire passage part
610*b*: lower side surface fitting part 611: first locking catch jaw
612: unlocking handle part 612*a*: lock stopper protrusion part
620: first locking catch part 630: second locking catch jaw part
640: locking side part 650: second locking catch part

Best Mode

Hereinafter, the present disclosure will be described in more detail.

A preferred exemplary embodiment of the present disclosure will be described in detail with reference to the accompanying drawings. Prior to the detailed description of the present disclosure, the terms or words used in the present specification and claims described below should not be construed as being limited to common or dictionary meanings. Accordingly, the exemplary embodiment described in the present specification and the configurations shown in the drawings is only the most preferred exemplary embodiment of the present disclosure, and do not represent all the technical ideas of the present disclosure, and accordingly, it should be appreciated that there may be equivalents and modifications at the time when the present application is filed.

Figure 2:
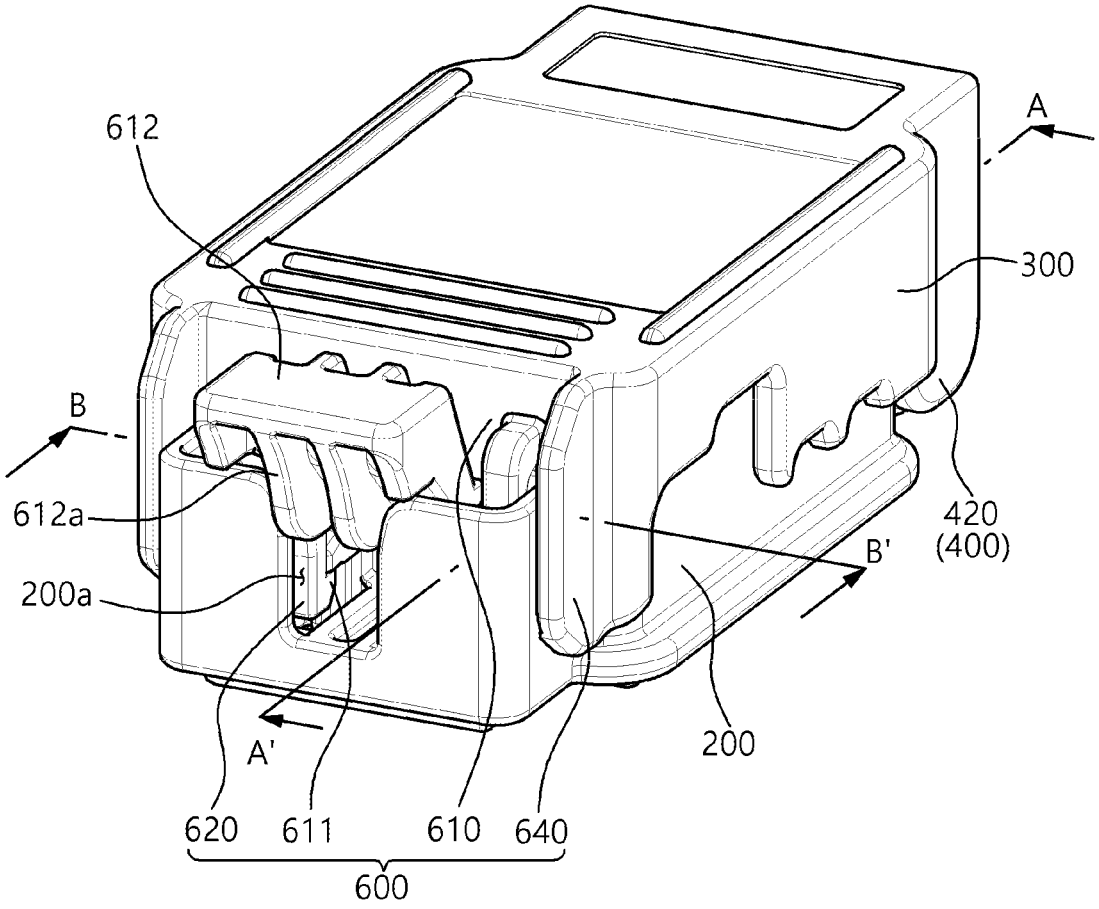
Figure 3:
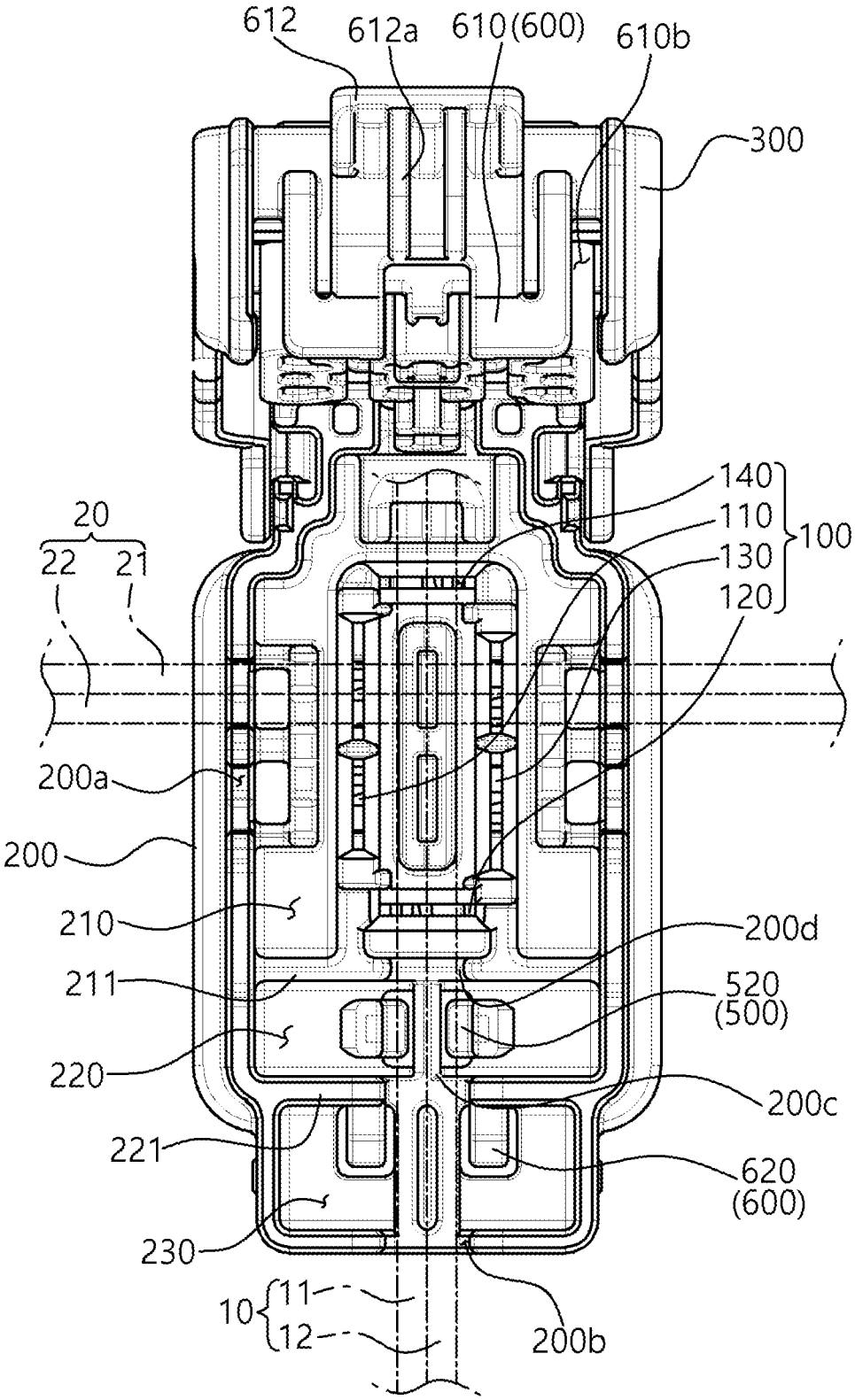
FIG. 3 is a plan view illustrating a lower casing member in the detonator connector having the leg wire locking structure according to the present disclosure.
Figure 4:
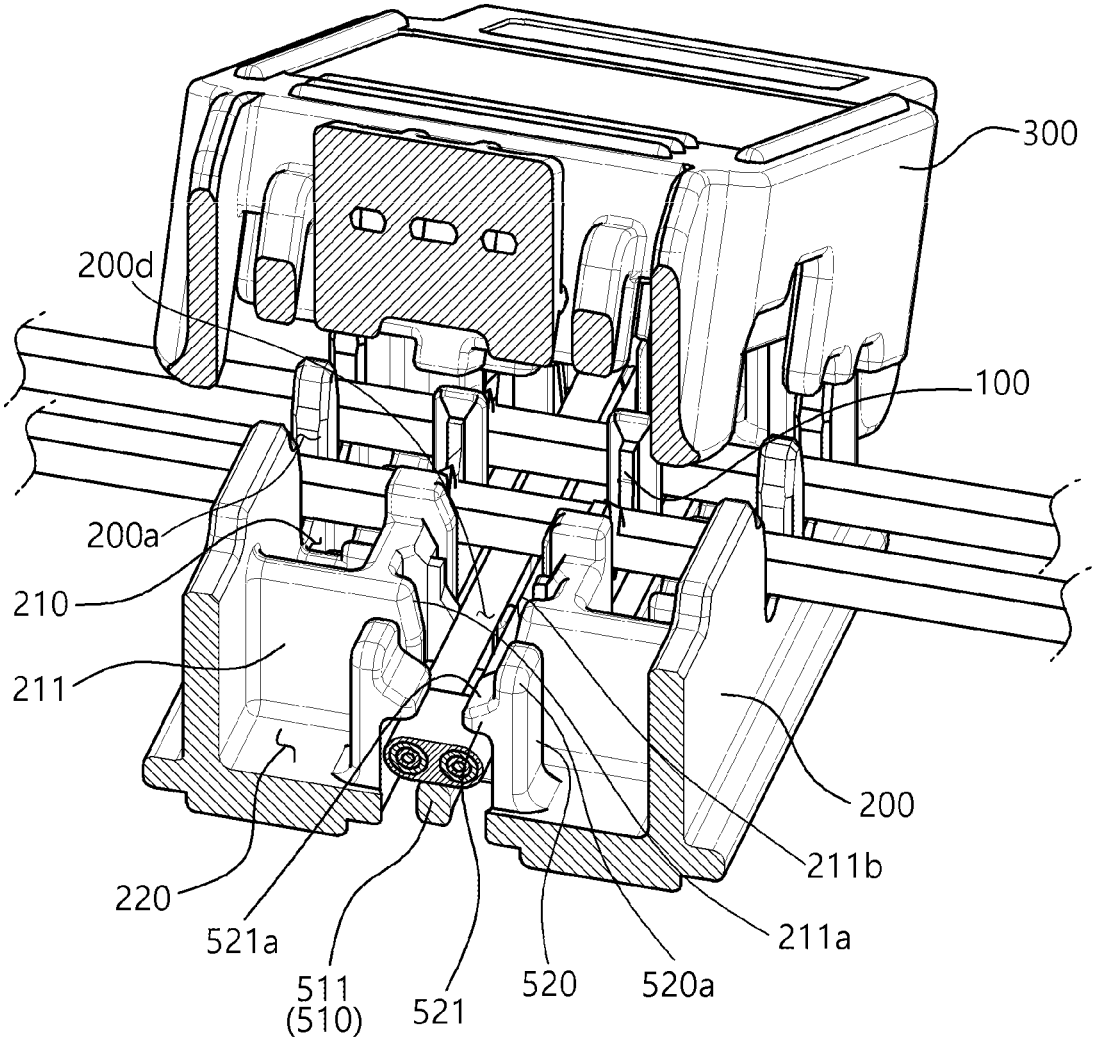
FIG. 4 is a cross-sectional perspective view illustrating a leg wire position locking part in the detonator connector having the leg wire locking structure according to the present disclosure.
Figure 5:
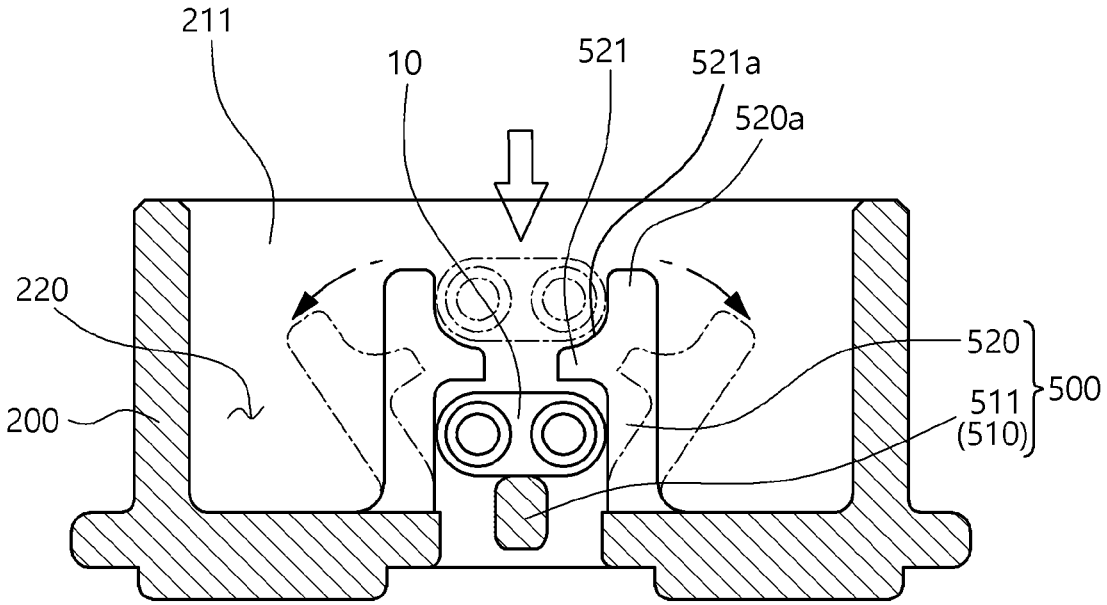
FIG. 5 is a cross-sectional view illustrating the leg wire position locking part in the detonator connector having the leg wire locking structure according to the present disclosure.

FIGS. 1 and 2 are views illustrating the exemplary embodiment of a detonator connector having a leg wire locking structure according to the present disclosure. FIG. 3 is a plan view of a lower casing member 200 in the detonator connector having the leg wire locking structure according to the present disclosure. FIG. 4 is a cross-sectional perspective view illustrating a leg wire position locking part 500 in the detonator connector having the leg wire locking structure according to the present disclosure. FIG. 5 is a cross-sectional view illustrating the leg wire position locking part 500 in the detonator connector having a leg wire locking structure according to the present disclosure.

FIG. 1 is a view illustrating a state where an upper side of the lower casing member 200 is opened along with an opened upper casing member 300 in the detonator connector having the leg wire locking structure according to the present disclosure. FIG. 2 is a view illustrating a state where the upper casing member 300 coupled to the lower casing member 200 is closed in the detonator connector having the leg wire locking structure according to the present disclosure.

In addition, FIG. 3 is a plan view illustrating the lower casing member 200 in the detonator connector having the leg wire locking structure according to the present disclosure, and illustrating an example in which a bus wire 20 and a leg wire 10 are wired inside the lower casing member 200.

Referring to FIGS. 1 to 5, the exemplary embodiment of the detonator connector having the leg wire locking structure according to the present disclosure will be described in detail below.

The exemplary embodiment of the detonator connector having the leg wire locking structure according to the present disclosure includes a wiring bracket member 100 made of a conductive material and in which a plurality of wire fitting grooves into which a leg wire 10 or a bus wire 20 of the detonator is inserted is formed.

In addition, the wiring bracket member 100 is inserted into the lower casing member 200 and positioned thereto, and the upper casing member 300 is connected to a rear side of the lower casing member 200 to be rotatable by a casing connection hinge part 400.

On the rear side of the lower casing member 200, there is provided the casing connection hinge part 400 for connecting the lower casing member 200 to the upper casing member 300 that rotates to open and close an upper side of the lower casing member 200.

An inside of the lower casing member 200 is opened and closed by the upper casing member 300 rotatably connected to the casing connection hinge part 400. The upper casing member 300 covers an open upper part of the lower casing member 200 and protects a bus wire 20 and leg wire 10 that are wired therein from an external environment.

The casing connection hinge part 400 includes: hinge shafts 410 protruding from both sides of the lower casing member 200; and hinge cover parts 420 extending downward from both sides of the upper casing member 300 and rotatably hinged to the respective hinge shafts 410.

As an example, the hinge shafts 410 are positioned on both sides of a first casing connection part positioned at a rear end side of the lower casing member 200. As an example, the hinge cover parts 420 are positioned on both sides of a second casing connection part positioned at a rear end side of the upper casing member 300 to cover both sides of the first casing connection part, and on an inner surface, shaft insertion grooves (not shown) to which the hinge shafts 410 are inserted are positioned.

Although not shown, by including a folding part, the casing connection hinge part 400 may also have a structure that allows both respective ends thereof to be integrally connected to a rear surface of the lower casing member 200 and a rear surface of the upper casing member 300, so as to rotate the upper casing member 300 while being folded and unfolded around the folding part as a center.

In addition, a casing locking part 600 for fixing a position of the closed upper casing member 300 is provided in front sides of the lower casing member 200 and upper casing member 300. The casing locking part 600 locks to allow the upper casing member 300 to be seated on an upper part of the lower casing member 200 so that a position of the upper casing member 300 covering the upper part of the lower casing member 200 may be fixed, and unlocks a locked state so that the lower casing member 200 may be opened.

The wiring bracket member 100 is made of a conductive material so that a leg wire 10 of a detonator or a bus wire 20 of a blasting machine, which is fitted into the plurality of wire fitting grooves 110, may be electrically connected to each other.

At an entrance of each wire fitting groove 110, a V-shaped guide part for guiding a wire to be fitted to a wire fitting groove 110 is positioned, so that when the upper casing member 300 is closed later, a bus wire 20 is pressurized and easily fitted to the wire fitting groove 110 and coupled thereto.

It should be noted that the wiring bracket member 100 is made of a material such as copper or aluminum, which has excellent conductivity, and may be made of any known material capable of electrically connecting a leg wire 10 and a bus wire 20 to each other.

In the wiring bracket member 100, the leg wire 10 is fitted to any one side of the plurality of wire fitting grooves 110, and the bus wire 20 is fitted to another side of the plurality of wire fitting grooves 110, whereby the leg wire 10 and the bus wire 20 are wired to each other.

It should be noted that a leg wire 10 or a bus wire 20 may be variously modified and implemented by using a known electric wire in a form of wire wrapped in a coating, so a detailed description thereof will be omitted.

The leg wire 10 is connected to the wiring bracket member 100 by passing through any one side of the plurality of wire fitting grooves 110, and the bus wire 20 is connected to the wiring bracket member 100 by passing through any one side of the plurality of wire fitting grooves 110.

The leg wire 10 and the bus wire 20 are fitted to the wire fitting grooves 110 different from each other, so as to be electrically connected to the wiring bracket, thereby being wired to each other.

The coatings of the leg wire 10 and bus wire 20 at a part fitted to the wire fitting groove 110 are peeled off to expose internal wires thereof, and while being connected to the wiring bracket 110, the exposed wires are wired to each other through the wiring bracket 110 made of a conductive material.

A bus wire 20 includes a first bus wire 21 for positive pole (+) and a second bus wire 22 for negative pole (−). A leg wire 10 includes: a first leg wire 11 for positive pole (+) electrically connected, i.e., wired, to the first bus wire 21 for positive pole (+) through a first wiring bracket part 101; and a second leg wire 12 for negative pole (−) electrically connected, i.e., wired, to the second bus wire 22 for negative pole (−) through a second wiring bracket part 102.

As an example, the first bus wire 21 and the second bus wire 22 have a known electric wire structure where the coatings thereof are positioned side by side and adhere to each other, and may be separated from each other by tearing a boundary part of the coatings at a boundary of the coatings, and the first leg wire 11 and the second leg wire 12 have a known electric wire structure where the coatings thereof are positioned side by side and adhere to each other, and may be separated from each other by tearing a boundary portion of the coatings at a boundary of the coatings.

The wiring bracket member 100 includes: a first bus wire connection bracket part 110 positioned apart from a first side surface of the lower casing member 200 and to which a first bus wire 21 is fitted and connected; a first leg wire connection bracket part 120 formed by being bent at a first end side of the first bus wire connection bracket part 110 and to which a first leg wire 11 is fitted and connected; a second bus wire connection bracket part 130 positioned apart from a second side surface of the lower casing member 200 and to which a second bus wire 22 is fitted and connected; and a second leg wire connection bracket part 140 formed by being bent at a second end side of the second bus wire connection bracket part 130 and to which a second leg wire 12 is fitted and connected.

The first bus wire connection bracket part 110 and the second bus wire connection bracket part 130 are positioned side by side and spaced apart from each other between both side surfaces of the lower casing member 200. The first leg wire connection bracket part 120 and the second leg wire connection bracket part 140 are positioned side by side and spaced apart from each other between the front and rear surfaces of the lower casing member 200.

A leg wire entrance through which a leg wire 10 may pass is positioned on the front side of the lower casing member 200. The inside of the lower casing member 200 is provided with a leg wire passage part positioned on a straight line with the leg wire entrance and configured to allow the leg wire 10, i.e., the first leg wire 11 and second leg wire 12, to be wired in a straight line.

The first leg wire connection bracket part 120 and the second leg wire connection bracket part 140 are positioned across the leg wire passage part, and are connected to each other by respectively fitting the first leg wire 11 and second leg wire 12, which are wired in a straight line in the leg wire passage part.

The first bus wire connection bracket part 110 is provided with a first bus wire fitting groove 101 to which a first bus wire 21 is fitted and connected and a second bus wire through hole 104 through which a second bus wire 22 passes. The second bus wire connection bracket part 130 is provided with a first bus wire through hole 103 through which the first bus wire 21 passes and a second bus wire fitting groove 102 to which the second bus wire 22 is fitted and connected.

In addition, the first leg wire connection bracket part 120 is provided with a first leg wire fitting groove 105 to which a first leg wire 11 is fitted and connected and a second leg wire through hole 108 through which a second leg wire 12 passes. The second leg wire connection bracket part 140 is provided with a second leg wire fitting groove 106 to which the second leg wire 12 is fitted and connected and a first leg wire through hole 107 through which the first leg wire 11 passes.

Lower sidewalls 200*a* protruding upward from both sides of the lower casing member 200 are positioned. Side through holes 200*a* through which the first bus wire 21 and the second bus wire 22 pass are positioned in both sides of the lower sidewalls 200*a*.

The first bus wire fitting groove 101 and the first bus wire through hole 103 are positioned on a straight line, the second bus wire through hole 104 and the second bus wire fitting groove 102 are positioned on a straight line, and the first bus wire fitting groove 101, the first bus wire through hole 103, the second bus wire through hole 104, and the second bus wire fitting groove 102 are disposed on a straight line with the side through holes 200*a*, so that the first bus wire 21 and the second bus wire 22 pass through the side through holes 200*a* on both sides of the lower casing member 200 and are respectively fitted and connected to the first bus wire fitting groove 101 and the second bus wire fitting groove 102.

The first leg wire fitting groove 105 and the first leg wire through hole 107 are positioned on a straight line in a wiring direction of a leg wire 10, and the second leg wire through hole 108 and the second leg wire fitting groove 106 are positioned on a straight line in the wiring direction of the leg wire 10.

In addition, the first leg wire 11 and the second leg wire 12 are wired in a straight line in the leg wire passage part inside the lower casing member 200 through the leg wire entrance. The first leg wire 11 is fitted and connected to the first leg wire fitting groove 105 in the first leg wire connection bracket part 120, and passes through the first leg wire through hole 107 in the second leg wire connection bracket part 140. The second leg wire 12 passes through the second leg wire through hole 108 in the first leg wire connection bracket part 120, and is fitted and connected to the second leg wire fitting groove 106 in the second leg wire connection bracket part 140.

The first bus wire 21 and the first leg wire 11 are connected to each other by the first bus wire connection bracket part 110 and the first leg wire connection bracket part 120. The second bus wire 22 and the second leg wire 12 are connected to each other by the second bus wire connection bracket part 130 and the second leg wire connection bracket part 140.

Meanwhile, on a lower surface of the upper casing member 300, there may be positioned a wiring pressurizing part 310 for pressurizing the leg wire 10 or the bus wire 20 to insert the leg wire 10 or the bus wire 20 into the wire fitting groove 110 and wiring the leg wire 10 or the bus wire 20 to the wiring bracket member 100.

While pressurizing the leg wire 10 or the bus wire 20 so as to be inserted into the wire fitting groove 110, the wiring pressurizing part 310 causes the coatings of the leg wire 10 and the bus wire 20 to be peeled off in the wire fitting groove 110, thereby allowing the leg wire 10 or the bus wire 20 to be electrically connected to, i.e., access, the wiring bracket member 100.

The wire fitting groove 110 is formed with a width equal to or smaller than a diameter of a wire excluding a coating of a leg wire 10 or bus wire 20, thereby enabling the leg wire 10 or bus wire 20 to be inserted as the coating thereof is peeled off at a time of the insertion.

In a state of being placed on an entrance of the wire fitting groove 110, i.e., on a V-shaped guide part, the leg wire 10 or bus wire 20 is electrically connected to, i.e., access, the wiring bracket member 100 as the coating only at a part fitted to the wire fitting groove 110 is peeled off while being pressurized by the wiring pressurizing part 310 and fitted to the wire fitting groove 110.

A bracket insertion part 311 into which the wiring bracket member 100 protruding from the upper side of the lower casing member 200 may be inserted when the upper casing member 300 is closed is positioned in the wiring pressurizing part 310.

When the upper casing member 300 is closed, as the wiring bracket member 100 is inserted into the bracket insertion part, the wiring pressurizing part 310 pressurizes the leg wire 10 or the bus wire 20, which is placed on the V-shaped guide part, so as to be inserted into the wire fitting groove 110.

In addition, in a state where the upper casing member 300 is closed, the wiring pressurizing part 310 pressurizes the leg wire 10 or the bus wire 20 inside the lower casing member 200, so that a position of the leg wire 10 or bus wire 20 is firmly fixed.

More specifically, the wiring pressurizing part 310 includes: a first wiring pressurizing member 311 inserted between the first side surface of the lower casing member 200 and the first bus wire connection bracket part 110; a second wiring pressurizing member 312 inserted between the first bus wire connection bracket part 110 and the second bus wire connection bracket part 130; a third wiring pressurizing member 313 inserted between the second bus wire connection bracket part 130 and the second side surface of the lower casing member 200; a fourth wiring pressurizing member 314 positioned at the first end side of the second wiring pressurizing member 312 and provided with a first bracket insertion part 314*a* into which the first leg wire connection bracket part 120 is inserted; and a fifth wiring pressurizing member 315 positioned at the second end side of the second wiring pressurizing member 312 and provided with a second bracket insertion part 315*a* into which the second leg wire connection bracket part 140 is inserted.

A third bracket insertion part 310*a* into which a first bus wire connection bracket is inserted is positioned between the first wiring pressurizing member 311 and the second wiring pressurizing member 312. A fourth bracket insertion part 310*b* is positioned between the second wiring pressurizing member 312 and the third wiring pressurizing member 313.

In addition, the side through holes 200*a* are formed to open upward. on both sides of the upper casing member 300, bus wire pressurizing holes 300*a* formed to open toward lower surfaces and configured to pressurize the bus wire 20 as a part of a bus wire 20 passing through the side passage hole 200*a* is inserted thereto is positioned.

When the upper casing member 300 is closed and a closed state is locked by the casing locking part 600, the first leg wire connection bracket part 120 is inserted into the first bracket insertion part and the second leg wire connection bracket part is inserted into the second bracket insertion part, so that each of the fourth wiring pressurizing member 314 and the fifth wiring pressurizing member 315 pressurizes the first leg wire 11 and the second leg wire 12 and causes the first leg wire 11 and the second leg wire 12 to be respectively fitted to the first leg wire fitting groove 105 and the second leg wire fitting groove 106, thereby electrically connecting the first leg wire connection bracket part 120 and the second leg wire connection bracket part 140 to each other.

In addition, when the upper casing member 300 is closed and the closed state is locked by the casing locking part 600, the first bus wire connection bracket part 110 is inserted into a third bracket insertion part and the second bus wire connection bracket part 130 is inserted into a fourth bracket insertion part, so that each of the first wiring pressurizing member 311, the second wiring pressurizing member 312, and the third wiring pressurizing member 313 pressurizes the first bus wire 21 and the second bus wire 22 and causes the first leg wire 11 and the second leg wire 12 to be respectively fitted and coupled to the first leg wire fitting groove 105 and the second leg wire fitting groove 106, thereby electrically connecting the first leg wire connection bracket part 120 and the second leg wire connection bracket part 140 to each other.

In addition, when the upper casing member 300 is closed and the closed state is locked by the casing locking part 600, both side parts of the lower casing member 200 and both side parts of the upper casing member 300 partially overlap, so as to pressurize an upper part of the bus wire 20 passing through the side through holes 200*a* by the bus wire pressurizing holes 300*a*, whereby a position of the bus wire 20 may be firmly fixed.

Meanwhile, a leg wire entrance allowing a leg wire 10 to be wired therein is positioned on the front side of the lower casing member 200, and between the leg wire entrance and the wiring bracket member 100, a leg wire position locking part for fixing a position of the leg wire 10 by elastically catching and pressurizing the leg wire 10 is positioned.

The leg wire position locking part 500 is positioned between the leg wire entrance and the first leg wire connection bracket part 120 to fix the position of the leg wire 10 wired in the leg wire passage part.

The leg wire position locking part 500 includes: a leg wire position support part 510 having an upper part thereof on which a leg wire 10 is placed; and a pair of leg wire support members 520 positioned standing upright on both sides of a leg wire 10 passing through the leg wire entrance to be wired inside the lower casing member 200, configured to support both sides of the leg wire 10, and provided with upper end sides thereof from which leg wire catch jaw parts 521 protrude to catch an upper part of the leg wire 10.

The pair of leg wire support members 520 is positioned standing upright and has a rod shape with elasticity, and may allow the leg wire 10 to be inserted into a gap created upon widening when both sides of the leg wire 10 are pressurized from an upper side, and returns to an original position by the elasticity when the leg wire 10 passes between the leg wire catch jaw parts 521 facing each other so as to be inserted into the gap, thereby fixing the position of the leg wire 10 by catching the upper part of the leg wire 10 with the leg wire catch jaw parts 521.

A height of each leg wire catch jaw part 521, from an upper surface of the leg wire position support part 510 on which the leg wire 10 is seated, has a height of 95% or more and less than 100% compared to a thickness of the leg wire 10, so that the pair of leg wire support members 520 elastically pressurizes the leg wire 10, which is seated on the leg wire position support part 510, with each of the leg wire catch jaw parts 521 protruding inward, thereby enabling to fix the position of the leg wire 10.

The pair of leg wire support members 520 is provided with leg wire support rib parts 520*a* extending and protruding from respective upper parts of the leg wire catch jaw parts 521 to support both sides of the leg wire 10 placed between the pair of leg wire support members 520.

When the leg wire 10 is placed and pressurized on upper surfaces of the leg wire catch jaw parts 521, the leg wire support rib parts 520*a* support both side ends of the leg wire 10 and guide vertical movement of the leg wire 10, so as to allow the leg wire 10 to easily pass between the leg wire catch jaw parts 521 and reduce a force by which an operator causes the leg wire 10 to pass between the leg wire catch jaw parts 521, whereby convenience of work may be secured.

In addition, each of the upper surfaces of the leg wire catch jaw parts 521 has an inclined surface or is formed in a circular arc shape having a curvature, thereby enabling the pair of leg wire support members 520 to be bent elastically and smoothly when the leg wire 10 is placed and pressurized.

More specifically, each of the upper surfaces of the leg wire catch jaw parts 521 is formed of a circular arc surface 521*a* having a curvature equal to or greater than a curvature of a leg wire 10, i.e., a curvature including the coating of the leg wire 10, so that when the leg wire 10 is placed and pressurized from an upper side, the pair of leg wire support members 520 may be elastically and smoothly bent and opened.

On a lower surface of the upper casing member 300, there is provided a leg wire support protrusion part 320 for supporting the upper surface of the leg wire 10 passed between the pair of leg wire catch jaw parts 521 and positioned by catching of the leg wire catch jaw parts 521 between the pair of leg wire support members 520.

In a state where the upper casing member 300 closes the upper side of the lower casing member 200, the leg wire support protrusion part 320 supports the upper surface of the leg wire 10 locked with the pair of leg wire catch jaw parts 521 between the pair of leg wire support members 520, thereby limiting the movement of the leg wire 10 so as not to lift toward an upper side.

In a state where the upper casing member 300 is closed, the leg wire support protrusion part 320 presses and supports the upper surface of leg wire 10 locked between the pair of leg wire support members 520, so that the movement of the leg wire 10 to the upper side may be completely restricted.

In addition, as an example, the leg wire position support part 510 is a support rod member 511 having elasticity and disposed in a straight line in the wiring direction of the leg wire 10.

The support rod member 511 is positioned in the center of the leg wire 10 at the bottom of the leg wire 10 to elastically support the leg wire 10, so as to enable the pair of leg wire catch jaw parts 521 to be elastically bent when hanging and supporting the upper surface of the leg wire 10, whereby the position of the leg wire 10 may be firmly fixed.

The support rod member 511 is positioned to be spaced apart from the lower surface of the lower casing member 200, and is positioned to support a central part of leg wire 10, i.e., a lower part of a boundary portion where the coatings of the first leg wire 11 and the second leg wire 12 adhere to each other.

The inside of the lower casing member 200 includes: a wiring space part 210 provided with a wiring bracket member 100 positioned therein and in which a leg wire 10 and a bus wire 20 are wired and connected to each other by the wiring bracket member 100; and a leg wire locking space part 220 divided by a first partition wall 211 at a front side of the wiring space part 210 and provided with a leg wire position locking part 500 positioned therein.

In addition, the inside of the lower casing member 200 further includes: a casing locking space part 230 divided by a second partition wall 221 at a front side of the leg wire locking space part 220 and provided with a casing locking part 600 therein.

In the lower casing member 200, the wiring space part 210 is positioned at an inner side of the first partition wall 211, the leg wire locking space part 220 is positioned between the first partition wall 211 and the second partition wall 221, and the casing locking space part 230 is positioned between the second partition wall 221 and the front surface of the lower casing member 200.

A first leg wire entrance 200*b* is positioned in the front side of the lower casing member 200, and a second leg wire entrance 200*c* and a third leg wire entrance 200*d*, which are positioned in a straight line with the first leg wire entrance 200*b*, are respectively provided in the second partition wall 221 and the first partition wall 211.

On both respective sides of the third leg wire entrance 200*d* positioned on the first partition wall 211, a first guide inclined surface 211*a* and a second guide inclined surface 211*b*, which have upper sides thereof, are positioned and guide a leg wire 10 so as to be inserted between the leg wire support members 520 by moving the leg wire 10 inward when the leg wire 10 is inserted into the upper sides.

The first guide inclined surface 211*a* and the second guide inclined surface 211*b* are formed by inclined surfaces having a V shape and facing each other, so as to guide a leg wire 10 toward both side surfaces of the third leg wire entrance 200*d* positioned in an inner middle.

The first guide inclined surface 211*a* and the second guide inclined surface 211*b* are configured to guide the leg wire 10 to be smoothly inserted between the leg wire support members 520.

In addition, the leg wire 10 may be fitted and coupled between both side surfaces of the third leg wire entrance 200*d*. The first guide inclined surface 211*a* and the second guide inclined surface 211*b* not only guide the leg wire 10 to be smoothly inserted between the leg wire support members 520, but also allow the leg wire 10 to be fitted and coupled to the third leg wire entrance 200*d*, thereby causing the position of the leg wire 10 to be more firmly fixed.

The leg wire 10 is wired in a straight line within the wiring space part 210 through the first leg wire entrance 200*b*, the second leg wire entrance 200*c*, and the third leg wire entrance 200*d*, so that the first leg wire 11 is fitted and connected to the first leg wire fitting groove 105 of the first leg wire connection bracket part 120 and the second leg wire 12 is fitted and connected to the second leg wire fitting groove 106 of the second leg wire connection bracket part 140.

In the lower casing member 200, the wiring space part 210 for wiring a bus wire 20 and a leg wire 10 to each other, the leg wire locking space part 220 for locking a position of the leg wire 10, and the casing locking space part 230 for locking the closed upper casing member 300 are divided independently of each other, so that a connection between the bus wire 20 and the leg wire 10 is made stable and the position of the leg wire 10 wired in the wiring space part 210 is stably fixed in the leg wire locking space part 220 and locked in the casing locking space by the closed upper casing member 300, whereby a locked state may be stably maintained.

In addition, opposite end sides of the support rod member 511 may be respectively fixed to the first partition wall 211 and second partition wall 221, so as to be stably positioned by being spaced apart from the lower surface of the lower casing member 200, thereby elastically supporting a lower part of the leg wire 10.

The leg wire 10 is placed on the support rod member 511 having elasticity, and an upper side of the leg wire 10 is caught by the leg wire catch jaw parts 521 of the leg wire support members 520 positioned standing upright on both sides and elastically pressurized by the leg wire catch jaw parts 521, so that while the leg wire 10 is elastically pressurized between the leg wire catch jaw parts 521 and the support rod member 511, a position of the leg wire 10 may be stably and firmly fixed.

Figure 6:
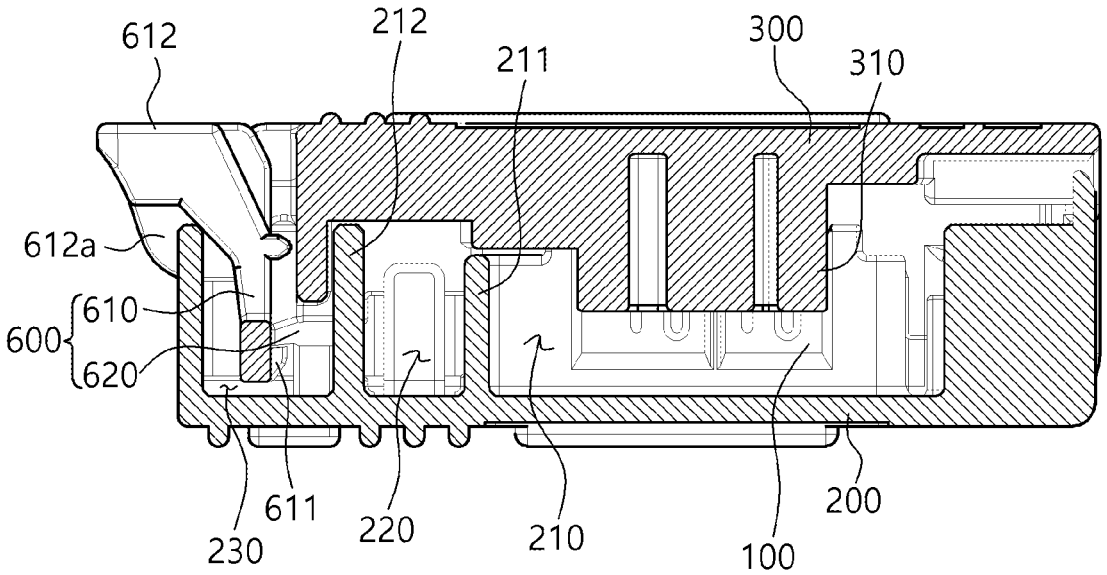
FIG. 6 is a view illustrating a cross-section taken along line A-A' of FIG. 1.
Figure 7:
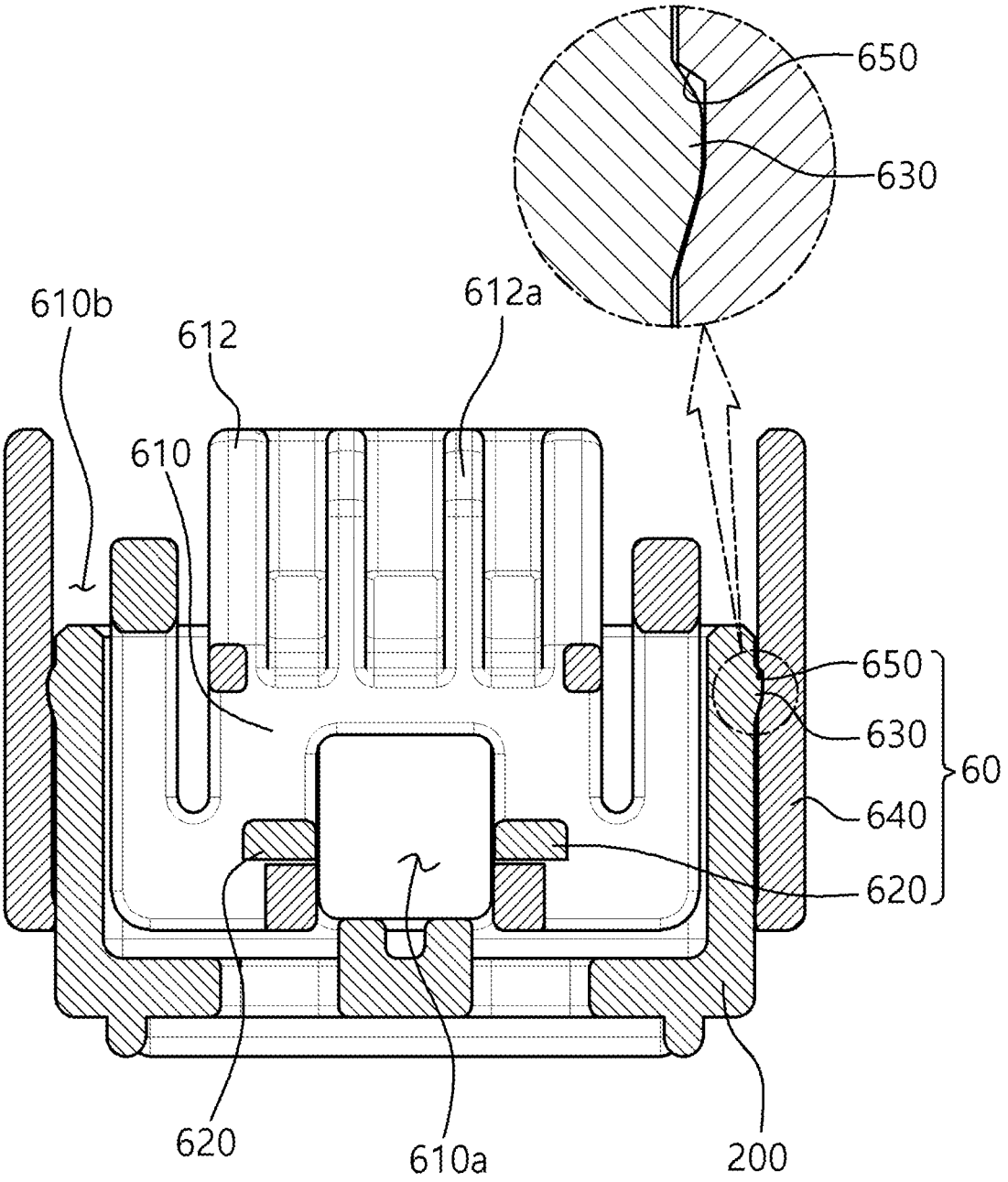
FIG. 7 is a view illustrating a cross-section taken along line B-B' of FIG. 1.

FIG. 6 is a view illustrating a cross section taken along line A-A' of FIG. 1, and FIG. 7 is a view illustrating a cross section taken along line B-B' of FIG. 1. With reference to FIGS. 1, 2, 6 and 7, an exemplary embodiment of a casing locking part 600 in the exemplary embodiment of the detonator connector having the leg wire locking structure according to the present disclosure will be described in detail below.

The casing locking part 600 includes: an elastic locking panel part 610 elastically bent in front and rear directions, provided with first locking catch jaws 611 protruding from lower end sides thereof, and positioned on a front surface of the upper casing member 300 so as to be inserted into the casing locking space part 230; and first locking catch parts 620 in which the first locking catch jaws 611 are caught and positioned in the casing locking space part 230.

A leg wire passage part 610*a* through which a leg wire 10 may pass is positioned in the elastic locking panel part 610. The leg wire passage part 610*a* is positioned on a straight line with the first leg wire entrance 200*b*, so as to allow the leg wire 10 passed through the first leg wire entrance 200*b* to pass through the second leg wire entrance 200*c* and the third leg wire entrance 200*d*.

The elastic locking panel part 610 includes an unlocking handle part 612 protrudes to the front and enabling an operator to pull or push the elastic locking panel part 610 by the operator's hand manipulation.

In addition, the first leg wire entrance 200*b* positioned on the front side of the lower casing member 200 is formed in a shape open to an upper side thereof. The unlocking handle part 612 includes lock stopper protrusion parts 612*a* protruding to be inserted into the first leg wire entrance 200*b* in the front, and allowing both side surfaces thereof to be supported by inner surfaces of the first leg wire entrance 200*b*, thereby guiding forward and backward movement of the elastic locking panel part 610.

By pulling or pushing the unlocking handle part 612, the operator may release a locked state of the first locking catch parts 620 caught and positioned by the first locking catch jaws 611. In this case, since the unlocking handle part 612 is inserted into the first leg wire entrance 200*b* and moves while being supported on the inner surfaces of the first leg wire entrance 200*b*, the locked state may be released stably with little force.

In addition, even when the upper casing member 300 is closed and the first locking catch jaws 611 are caught and locked by the first locking catch parts 620, since the unlocking handle part 612 is inserted into the first leg wire entrance 200*b* and moves while being supported on the inner surfaces of the first leg wire entrance 200*b*, the first locking catch jaws 611 may be caught and locked by the first locking catch parts 620 in a regular position.

In addition, in a state where the first locking catch jaws 611 are caught by the first locking catch parts 620, since the unlocking catch part is inserted into the first leg wire entrance 200*b* and restricted in movement in both directions, the first locking catch jaws 611 are caught by the first locking catch parts 620 in the regular position and stably maintained in the locked state, whereby the closed locked state of the upper casing member 300 may be firmly maintained.

Since the elastic locking panel part 610 is designed to use a seesaw principle for the lower case member 200, the resisting force of the unlocking handle part 612 against external interference is able to be increased by adjusting a position of a support point (i.e., a fulcrum).

In addition, the elastic locking panel part 610 increases the amount of flexibility of the unlocking handle part 612 against the external interference, so that even when the unlocking handle part 612 moves a lot, the fastening force of the first locking catch parts 620 may be maintained.

Accordingly, the casing locking part 600 enables the detonator connector to be easily redesigned and used in accordance with a working environment.

In addition, the casing locking part 600 may further include: second locking catch jaw parts 630 positioned on both sides of the lower casing member 200; locking side parts 640 positioned to cover the second locking catch jaw parts 630 on the front side of the upper casing member 300; and second locking catch parts 650 positioned on inner surfaces of the locking side parts 640 and into which the second locking catch jaw parts 630 are inserted and caught.

The casing locking part 600 may lock the closed state of the upper casing member 300 more firmly and stably with a double catch structure of using the first locking catch jaws 611 and the second locking catch jaw parts 630.

In addition, between the locking elastic panel part 610 and the locking side parts 640, there is provided lower side surface fitting parts 610*b* into which both side parts of the lower casing member 200, i.e., both side parts of the casing locking space part 230 are inserted.

While both side parts of the lower casing member 200, i.e., both side parts of the casing locking space part 230 are fitted and inserted into the lower side surface fitting parts 610*b*, the elastic locking panel part 610 is restricted in movement in both directions, whereby the first locking catch jaws 611 may be more stably maintained in a locked state by being caught by the first locking catch parts 620 in the regular position, and the locked state of the closed upper casing member 300 may be maintained more firmly.

The present disclosure may ensure that the position of the double-coated wire or single-coated wire used as the leg wire 10 may be elastically locked and fixed at the entrance side, so as to stably maintain the internal connection state, thereby securing connection stability and connection reliability between the leg wire 10 and the bus wire 20.

It should be noted that the present disclosure is not limited to the above-described exemplary embodiment, but can be implemented with various changes without departing from the gist of the present disclosure, and the changes are included in the configuration of the present disclosure.

The invention claimed is:

1. A detonator connector having a leg wire locking structure, the detonator connector comprising:

a wiring bracket member made of a conductive material and formed with a plurality of wire fitting grooves into which a leg wire of a detonator or a bus wire is inserted;

a lower casing member on which the wiring bracket member is positioned;

an upper casing member for covering an upper part of the lower casing member;

a casing locking part for fixing a position of the upper casing member is provided on front sides of the lower casing member and the upper casing member, wherein a leg wire position locking part for catching and fixing a position of the leg wire or the bus wire is positioned in an inside of the lower casing member, wherein the inside of the lower casing member further comprises a casing locking space part, wherein the casing locking part comprises:

an elastic locking panel part elastically bent in forward and backward directions, provided with first locking catch jaws protruding from lower end sides thereof, and positioned on the front side of the upper casing member so as to be inserted into the casing locking space part, wherein the elastic locking panel part is provided with an unlocking handle part protruding from a front side thereof and enabling an operator to pull or push the elastic locking panel part by hand manipulation, wherein a first leg wire entrance positioned on the front side of the lower casing member and through which the leg wire passes is formed in a shape open to an upper side, and the unlocking handle part is provided with a locking stopper protrusion part protruding to be inserted into the first leg wire entrance at a front and allowing both sides thereof to be supported on inner surfaces of the first leg wire entrance, so as to guide forward and backward movement of the elastic locking panel part and restrict leftward and rightward movement of the elastic locking panel part.

2. The detonator connector of claim 1, wherein the leg wire position locking part is positioned between a leg wire entrance of the lower casing member and the wiring bracket member, and elastically catches and pressurizes the leg wire inserted into the inside of the lower casing member.

3. The detonator connector of claim 1, wherein the leg wire position locking part comprises a pair of leg wire support members positioned standing upright and spaced apart from each other in the inside of the lower casing member to support both side surfaces of the leg wire wired in between, and provided with leg wire catch jaw parts protruding to catch an upper part of the leg wire.

4. The detonator connector of claim 3, wherein the pair of leg wire support members has a rod shape, is positioned standing upright, and is provided with the leg wire catch jaw parts protruding inward and positioned to face each other.

5. The detonator connector of claim 3, wherein an upper surface of each leg wire catch jaw part is formed of a circular arc surface having a curvature equal to or greater than a curvature of the leg wire comprising a coating thereof.

6. The detonator connector of claim 3, wherein the leg wire support members comprise respective leg wire support rib parts extending and protruding from upper parts of the leg wire catch jaw parts to support both sides of the leg wire in between.

7. The detonator connector of claim 3, wherein the leg wire position locking part further comprises a leg wire support part having an upper part thereof on which the leg wire is placed, and the leg wire support part is a support rod member disposed in a straight line in a wiring direction of the leg wire and having elasticity.

8. The detonator connector of claim 1, wherein a lower surface of the upper casing member is provided with a leg wire support protrusion part protruding to support an upper surface of the leg wire fixed by catching with the leg wire position locking part.

9. The detonator connector of claim 3, wherein partition walls each provided with a leg wire entrance, through which the leg wire passes, are provided on a front side or a rear side of the leg wire position locking part, and on both respective sides of the leg wire entrance, a first guide inclined surface and a second guide inclined surface, which have upper sides thereof, are positioned and guide the leg wire so as to be inserted between the leg wire support members by moving the leg wire inward when the leg wire is inserted into the upper sides.

10. The detonator connector of claim 1, wherein the inside of the lower casing member comprises:

a wiring space part provided with the wiring bracket members positioned therein and in which the leg wire and the bus wire are wired and connected to each other by the wiring bracket members; and a leg wire locking space part divided by a first partition wall at a front side of the wiring space part and provided with the leg wire position locking part positioned therein.

11. The detonator connector of claim 10, wherein the inside of the lower casing member further comprises the casing locking space part divided by a second partition wall at a front side of the leg wire locking space part and provided with the casing locking part therein.

12. The detonator connector of claim 11, wherein the leg wire position locking part further comprises a leg wire support part having an upper part thereof on which the leg wire is placed, the leg wire support part is a support rod member disposed in a straight line in a wiring direction of the leg wire and having elasticity, and opposite end sides of the support rod member are respectively fixed to the first partition wall and the second partition wall and positioned to be spaced apart from a lower surface of the lower casing member.

13. The detonator connector of claim 11, wherein the casing locking part comprises:

first locking catch parts by which the first locking catch jaws are caught and positioned within the casing locking space part.

14. The detonator connector of claim 13, wherein the casing locking part further comprises:

second locking catch jaw parts positioned on both sides of the lower casing member;

locking side parts positioned to cover the second locking catch jaw parts on the front side of the upper casing member; and second locking catch parts positioned on inner surfaces of the locking side parts and into which the second locking catch jaw parts are inserted and caught.

15. A detonator connector having a leg wire locking structure, the detonator connector comprising:

a wiring bracket member made of a conductive material and formed with a plurality of wire fitting grooves into which a leg wire of a detonator or a bus wire is inserted;

a lower casing member on which the wiring bracket member is positioned;

an upper casing member for covering an upper part of the lower casing member, and a casing locking part for fixing a position of the upper casing member is provided on front sides of the lower casing member and the upper casing member, wherein a leg wire position locking part for catching and fixing a position of the leg wire or the bus wire is positioned in an inside of the lower casing member, wherein the inside of the lower casing member further comprises a casing locking space part, wherein the casing locking part comprises:

an elastic locking panel part elastically bent in forward and backward directions, provided with first locking catch jaws protruding from lower end sides thereof, and positioned on the front side of the upper casing member so as to be inserted into the casing locking space part, wherein the elastic locking panel part is provided with an unlocking handle part protruding from a front side thereof and enabling an operator to pull or push the elastic locking panel part by hand manipulation, and wherein a lower side surface fitting part into which both side parts of the lower casing member are fitted and inserted are provided between the elastic locking panel part and the locking side parts.

16. The detonator connector of claim 15, wherein the wiring bracket member comprises:

a first bus wire connection bracket part positioned apart from a first side surface of the lower casing member and to which a first bus wire is fitted and connected;

a first leg wire connection bracket part formed by being bent at a first end side of the first bus wire connection bracket part and to which a first leg wire is fitted and connected;

a second bus wire connection bracket part positioned apart from a second side surface of the lower casing member and to which a second bus wire is fitted and connected; and a second leg wire connection bracket part formed by being bent at a second end side of the second bus wire connection bracket part and to which a second leg wire is fitted and connected.

17. The detonator connector of claim 16, wherein a wiring pressurizing part for pressurizing the leg wire or the bus wire, inserting the leg wire or the bus wire into a wire fitting groove, and wiring the leg wire or bus wire to the wiring bracket members is positioned on a lower surface of the upper casing member, and the wiring pressurizing part comprises:

a first wiring pressurizing member inserted between the first side surface of the lower casing member and the first bus wire connection bracket part;

a second wiring pressurizing member inserted between the first bus wire connection bracket part and the second bus wire connection bracket part;

a third wiring pressurizing member inserted between the second bus wire connection bracket part and the second side surface of the lower casing member;

a fourth wiring pressurizing member positioned at the first end side of the second wiring pressurizing member and provided with a first bracket insertion part into which the first leg wire connection bracket part is inserted; and a fifth connection pressure member positioned at the second end side of the second wiring pressurizing member and provided with a second bracket insertion part into which the second leg wire connection bracket part is inserted.

* * * * *